US012799844B2

(12) United States Patent
Goodman

(10) Patent No.: US 12,799,844 B2
(45) Date of Patent: Nov. 17, 2026

(54) CEMENTING STAGE TOOL AND ASSOCIATED METHODS

(71) Applicant: WEATHERFORD TECHNOLOGY HOLDINGS, LLC, Houston, TX (US)

(72) Inventor: Brandon C. Goodman, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 19/208,106

(22) Filed: May 14, 2025

(65) Prior Publication Data

US 2025/0270894 A1 Aug. 28, 2025

Related U.S. Application Data

(62) Division of application No. 18/422,896, filed on Jan. 25, 2024, now Pat. No. 12,404,741.

(Continued)

(51) Int. Cl.
*E21B 33/14* (2006.01)
*E21B 34/06* (2006.01)

(Continued)

(52) U.S. Cl.
CPC ..... *E21B 33/146* (2013.01); *E21B 34/063* (2013.01); *E21B 34/103* (2013.01); *E21B 34/142* (2020.05)

(58) Field of Classification Search
None
See application file for complete search history.

(56) References Cited

U.S. PATENT DOCUMENTS 5,024,273 A 6/1991 Coone et al.
5,109,925 A * 5/1992 Stepp ..... E21B 33/146 166/324

(Continued)

FOREIGN PATENT DOCUMENTS

CA 3134409 A1 8/2020
WO 2020165880 A1 8/2020

OTHER PUBLICATIONS

Weatherford, "Eliminator GT Series Stage Tool (Model 756)", product brochure, 2 pages, dated 2015.

(Continued)

*Primary Examiner* — Robert E Fuller
(74) *Attorney, Agent, or Firm* — Smith IP Services, P.C.

(57) ABSTRACT

A method of cementing a tubular string in a wellbore can include applying a predetermined pressure differential from a flow passage extending axially through the tubular string to an annulus surrounding the tubular string, thereby opening a rupture disk of a cementing stage tool connected in the tubular string, and then flowing a fluid through the flow passage and into the annulus via the rupture disk, thereby displacing an opening plug into engagement with an opening sleeve of the cementing stage tool. A cementing stage tool can include a longitudinal flow passage, an outer housing assembly, an opening sleeve that prevents fluid flow between the flow passage and a housing port in a run-in configuration, and a rupture disk that permits fluid flow between the flow passage and the housing port in response to a predetermined pressure differential applied from the flow passage to the housing port.

6 Claims, 7 Drawing Sheets

Related U.S. Application Data

(60) Provisional application No. 63/619,507, filed on Jan. 10, 2024.

(51) Int. Cl.
*E21B 34/10* (2006.01)
*E21B 34/14* (2006.01)

(56) References Cited

U.S. PATENT DOCUMENTS

| | | | |
|---|---|---|---|
| 5,314,015 | A | 5/1994 | Streich et al. |
| 8,066,069 | B2 | 11/2011 | Giroux et al. |
| 8,672,030 | B2 | 3/2014 | Sherman |
| 8,783,351 | B2 | 7/2014 | Lee et al. |
| 9,765,594 | B2 | 9/2017 | Sherman et al. |
| 9,856,714 | B2 | 1/2018 | Giroux et al. |
| 9,915,122 | B2 | 3/2018 | Hofman et al. |
| 10,975,662 | B2 | 4/2021 | Klam |
| 11,180,958 | B2 | 11/2021 | Getzlaf et al. |
| 11,268,348 | B2 | 3/2022 | Nordheimer et al. |
| 11,603,735 | B2 | 3/2023 | Hijles |
| 11,702,904 | B1 * | 7/2023 | Anton ..... E21B 34/108 166/278 |
| 11,713,646 | B2 | 8/2023 | Giroux et al. |
| 2015/0345252 | A1 | 12/2015 | Mcnabb et al. |
| 2021/0115735 | A1 | 4/2021 | Getzlaf et al. |
| 2022/0372842 | A1 | 11/2022 | Saraya |

OTHER PUBLICATIONS

Weatherford, "Eliminator H Model 754 Stage Tool", product brochure, 2 pages, dated 2016.

Weatherford, "Eliminator M Stage Tool Models 751E, 752E, 751PD, 752PD, and 753PD", product brochure, 3 pages, dated 2016.

Office Action issued Feb. 27, 2025 for U.S. Appl. No. 18/422,896, 12 pages.

* cited by examiner

CEMENTING STAGE TOOL AND ASSOCIATED METHODS

CROSS-REFERENCE TO RELATED APPLICATIONS

This application is a division of prior application Ser. No. 18/422,896 filed on 25 Jan. 2024, which claims the benefit of the filing date of U.S. provisional application No. 63/619,507 filed on 10 Jan. 2024. The entire disclosures of the prior applications are incorporated herein by this reference in their entireties for all purposes.

BACKGROUND

This disclosure relates generally to equipment utilized and operations performed in conjunction with a subterranean well and, in an example described below, more particularly provides a cementing stage tool and associated methods.

A cementing stage tool can be used to control communication between a tubular string bore and an annulus surrounding the tubular string in a cementing operation. It is very important for such communication between the tubular string bore and the annulus to be selectively permitted or prevented at various different points in the cementing operation.

It will, therefore, be readily appreciated that improvements are continually needed in the art of designing, constructing and utilizing cementing stage tools. The present disclosure provides such improvements to the art, which improvements may be useful in a wide variety of different types of well cementing operations.

DETAILED DESCRIPTION

Figure 1:
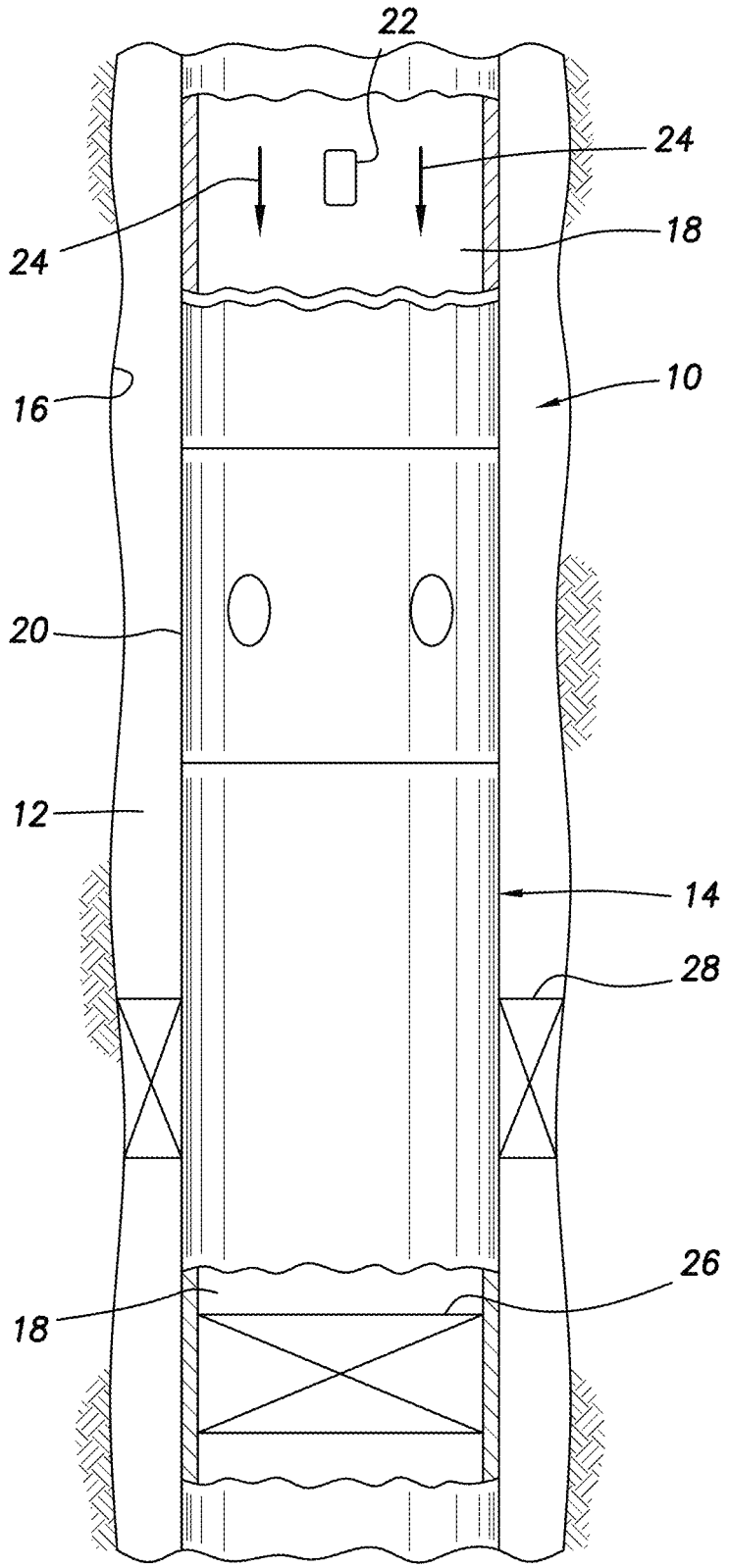
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, it is desired to place cement into an annulus 12 surrounding a tubular string 14. As depicted in FIG. 1, the annulus 12 is formed radially between the tubular string 14 and a wellbore 16 drilled into the earth. In other examples, the annulus 12 may be formed between the tubular string 14 and another tubular string (not shown) outwardly surrounding the tubular string 14.

In various examples, the tubular string 14 may be of the types known to those skilled in the art as casing, liner, tubing or pipe. The scope of this disclosure is not limited to use of any particular type of tubular string.

An inner flow passage 18 extends longitudinally through the tubular string 14. A cementing stage tool 20 is connected in the tubular string 14 to control fluid communication between the flow passage 18 and the annulus 12 during the cementing operation.

To actuate the cementing stage tool 20, so that fluid communication is permitted between the flow passage 18 and the annulus 12, it is desired to displace an opening plug 22 with circulating fluid flow 24 through the flow passage to the cementing stage tool. However, in the FIG. 1 example, such circulating fluid flow 24 is initially prevented by either a bridge plug 26 set in the flow passage 18 downhole of the cementing stage tool 20, or a packer 28 set in the annulus 12 downhole of the cementing stage tool.

Fortunately, the cementing stage tool 20 includes features that enable fluid communication to be established between the flow passage 18 and the annulus 12, so that the plug 22 can be displaced to the cementing stage tool with the fluid flow 24, even though circulating fluid flow is not initially permitted from the flow passage to the annulus through a sidewall of the cementing stage tool when it is initially deployed into the wellbore 16 with the tubular string 14.

Figure 2:
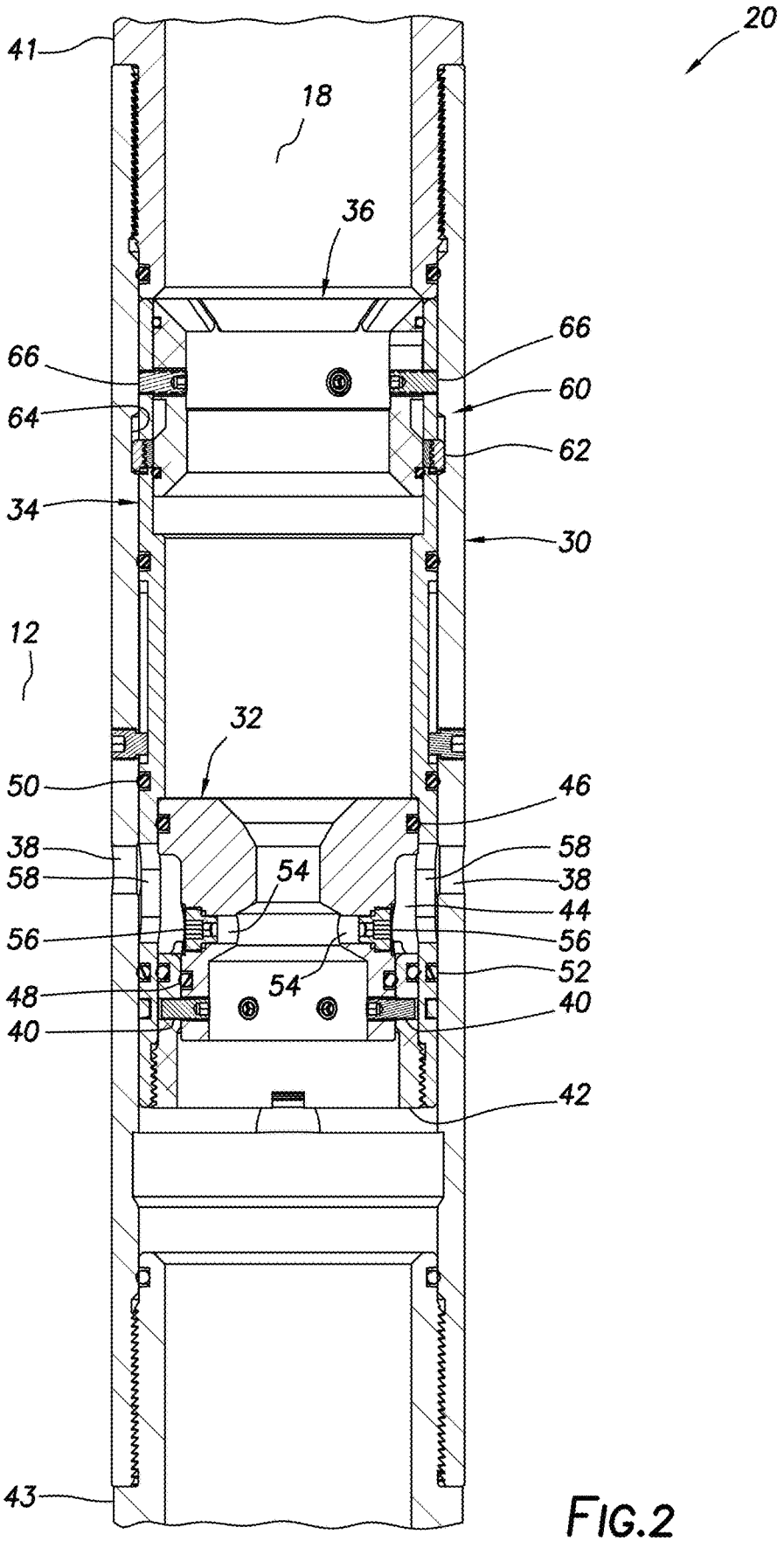
FIG. 2 is a representative cross-sectional view of an example of a cementing stage tool that may be used in the FIG. 1 system and method, the cementing stage tool being depicted in a run-in configuration.

Referring additionally now to FIG. 2, a cross-sectional view of an example of the cementing stage tool 20 is representatively illustrated. The FIG. 2 cementing stage tool 20 may be used with the FIG. 1 system 10 and method, or it may be used with other systems and methods. For convenience, the cementing stage tool 20 is described below as it may be used with the FIG. 1 system 10 and method.

As depicted in FIG. 2, the cementing stage tool 20 is in a run-in configuration. The cementing stage tool 20 is in this configuration when it is initially connected in the tubular string 14 and deployed into the wellbore 16 in the FIG. 1 system 10 and method.

In the FIG. 2 example, the cementing stage tool 20 includes a generally tubular outer housing assembly 30, an opening sleeve 32, a closing sleeve 34 and a release sleeve 36. As described more fully below, the opening and closing sleeves 32, 34 are used to selectively permit and prevent fluid communication between the flow passage 18 and the annulus 12 via one or more housing ports 38 formed through sidewall of the outer housing assembly 30.

The outer housing assembly 30 in this example includes upper and lower connectors 41, 43 for connecting the cementing stage tool 20 in the tubular string 14. For this purpose, the upper and lower connectors 41, 43 can include threads, seals, etc. to secure and seal the cementing stage tool 20 in the tubular string 14, while enabling the flow passage 18 to extend axially through the tool and isolating the flow passage from the annulus 12 at the tool.

The opening sleeve 32 is initially in a closed position in which it blocks fluid flow between the flow passage 18 and the annulus 12 via the housing ports 38. The opening sleeve 32 is initially retained in the closed position by shear members 40 (such as, shear screws, shear pins, a shear ring, etc.) or other releasable retainer members (such as, a snap ring, collets, etc.). In the FIG. 2 example, the shear members 40 extend through a sidewall of the opening sleeve 32 and into an abutment sleeve 42 threaded into a lower end of the closing sleeve 34.

An annulus 44 is isolated between upper and lower seals 46, 48. The seal 46 seals between the opening sleeve 32 and the closing sleeve 34, and the seal 48 seals between the opening sleeve and the abutment sleeve 42, respectively above and below the annulus 44. Similarly, upper and lower seals 50, 52 seal between the closing sleeve 34 and the outer housing assembly 30, respectively above and below the housing ports 38.

Circulation ports 54 are formed through the sidewall of the opening sleeve 32 axially between the seals 46, 48. Rupture disks 56 initially prevent fluid flow through the circulation ports 54. However, the rupture disks 56 are selected, so that they will open to permit fluid communication between the flow passage 18 and the annulus 12 when a predetermined pressure differential is applied from the flow passage to the annulus.

The closing sleeve 34 includes closing sleeve ports 58 formed through a sidewall of the closing sleeve. In the run-in configuration of the cementing stage tool 20, the closing sleeve ports 58 are in fluid communication with the housing ports 38 and the annulus 44. The closing sleeve 34 is releasably retained in this position by a lock mechanism 60.

The lock mechanism 60 includes radially retractable lock rings 62 radially outwardly supported in engagement with an annular recess 64 formed in the outer housing assembly 30. The lock rings 62 are outwardly supported by the release sleeve 36, which is releasably retained in this position by shear members 66 (such as, shear screws, shear pins, a shear ring, etc.) or other releasable retainer members (such as, a snap ring, collets, etc.). The shear members 66 extend through a sidewall of the release sleeve 36 and into the sidewall of the closing sleeve 34.

Figure 3:
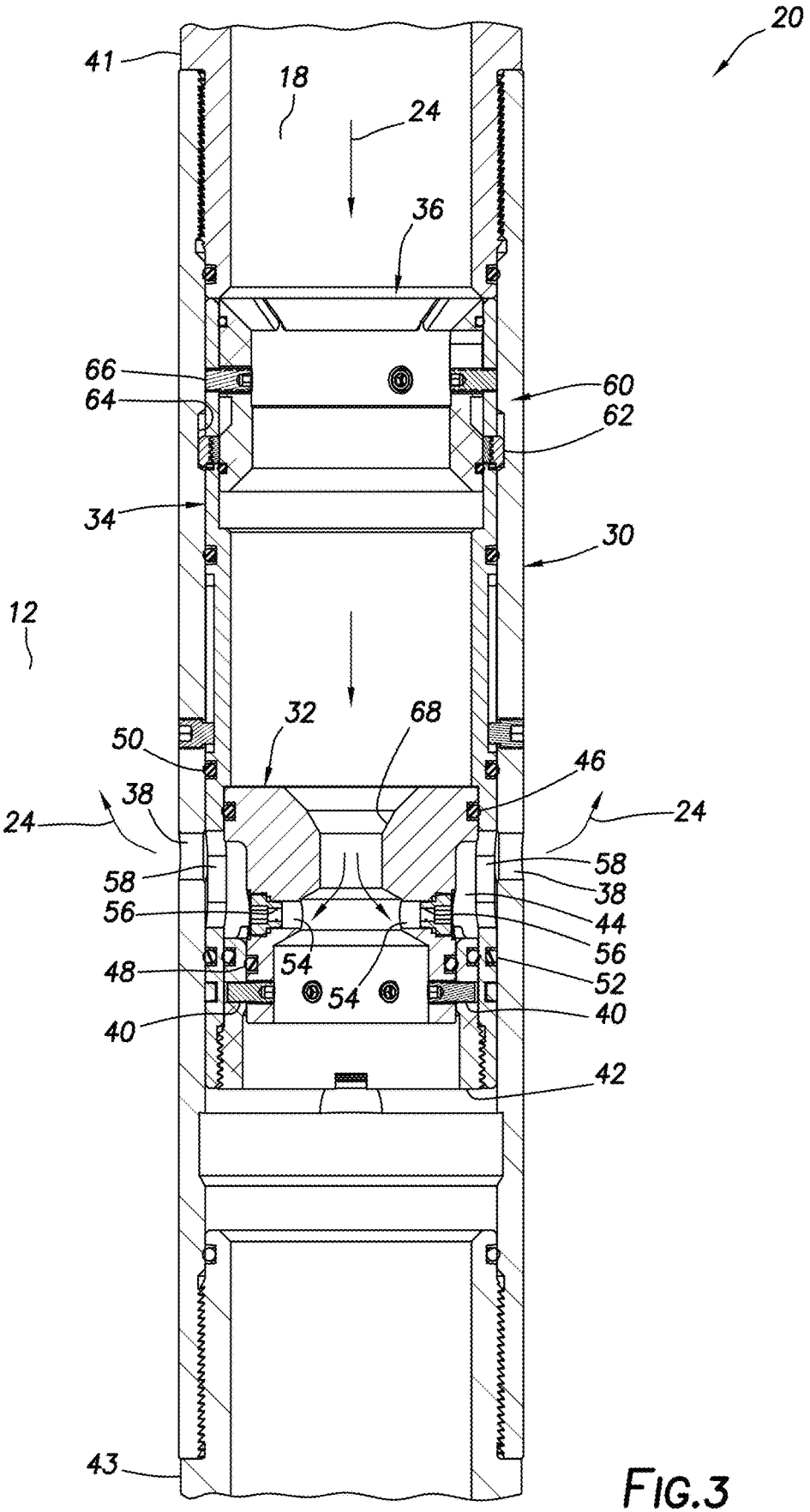
FIG. 3 is a representative cross-sectional view of the cementing stage tool in a circulate configuration.

Referring additionally now to FIG. 3, a cross-sectional view of the cementing stage tool 20 is representatively illustrated. As depicted in FIG. 3, the cementing stage tool 20 is in a circulate configuration in which fluid flow 24 is permitted from the flow passage 18 to the annulus 12.

The predetermined pressure differential has been applied from the flow passage 18 to the annulus 12 to thereby open the rupture disks 56. Fluid communication is, thus, permitted between the flow passage 18 and the annulus 12 via the circulation ports 54, the annulus 44, the closing sleeve ports 58 and the housing ports 38.

The circulating fluid flow 24 can be used to displace the plug 22 through the tubular string 14 to the cementing stage tool 20. Note that the fluid flow 24 passes through the relatively small flow area rupture disks 56, and so a flow rate of the fluid flow 24 will be relatively restricted. This restriction of fluid flow can be used to provide an indication of the cementing stage tool's circulate configuration (e.g., due to the circulation fluid flow 24 being permitted, but at a relatively low flow rate). Thus, an operator at the surface will be able to know positively that the cementing stage tool 20 is in the circulate configuration, instead of some other configuration.

Note that the rupture disks 56 are one example of a pressure operated flow control device that may be used to selectively permit fluid communication through the sidewall of the opening sleeve 32 in response to the predetermined pressure differential applied from the flow passage 18 to the annulus 12. In other examples, other types of flow control devices (such as, a sliding sleeve valve, a relief valve, etc.) may be used instead of the rupture disks 56.

Figure 4:
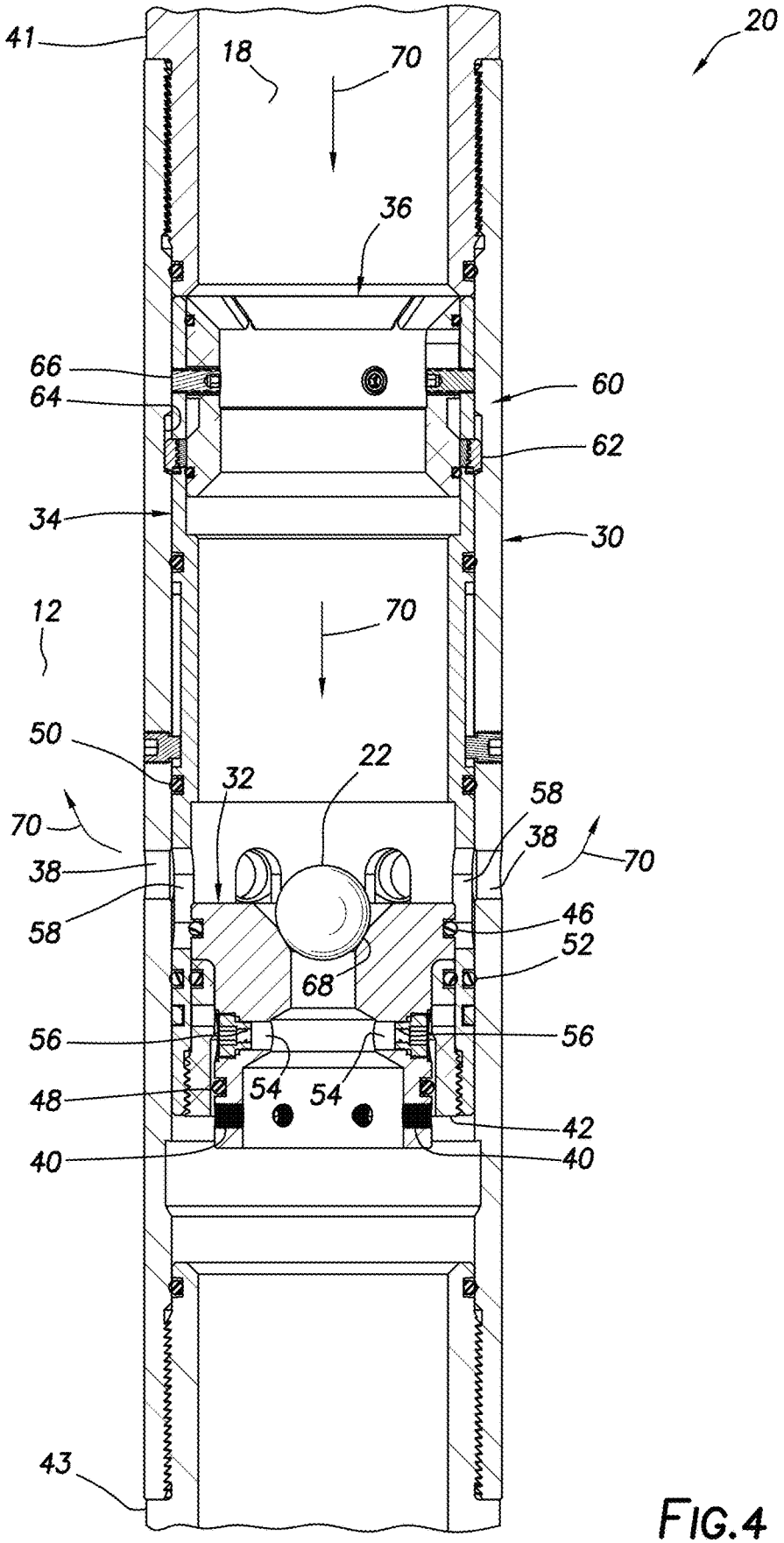
FIG. 4 is a representative cross-sectional view of the cementing stage tool in a cementing configuration.

Referring additionally now to FIG. 4, a cross-sectional view of the cementing stage tool 20 is representatively illustrated. As depicted in FIG. 4, the cementing stage tool 20 is in a cementing configuration.

In the FIG. 4 example, the plug 22 has been displaced into the cementing stage tool 20 with the circulating fluid flow 24 (see FIG. 3). The plug 22 has been displaced into sealing contact with an annular seat 68 formed in an upper end of the opening sleeve 32. The plug 22 now blocks fluid communication through the flow passage 18 at the opening sleeve 32.

As depicted in FIG. 4, the plug 22 is in the form of a ball or sphere. In other examples, the plug 22 could comprise a dart, a cylinder, or another shape or configuration suitable for blocking fluid flow through the opening sleeve 32.

After the plug 22 engages the seat 68, fluid pressure in the flow passage 18 uphole of the plug is increased until a predetermined pressure differential is applied across the plug and seat. The pressure differential is from the flow passage 18 uphole of the plug 22 to the flow passage downhole of the plug (including to the circulation ports 54, the annulus 44 (see FIG. 3), the closing sleeve ports 58, the housing ports 38 and the annulus 12). Note that this pressure differential may be greater than, less than or equal to the pressure differential described above for opening the rupture disks 56.

The predetermined pressure differential applied across the plug 22 and seat 68 causes the shear members 40 to shear, so that the opening sleeve 32 displaces downward in the housing assembly 30 to an open position as depicted in FIG. 4. The downward displacement of the opening sleeve 32 is limited by contact with an upper end of the abutment sleeve 42.

With the opening sleeve 32 in its FIG. 4 open position, fluid communication is permitted between the flow passage 18 and the annulus 12 via the closing sleeve ports 58 and the housing ports 38. However, fluid flow between the flow passage 18 and the annulus 12 will no longer pass through the sidewall of the opening sleeve 32 via the circulation ports 54 and the rupture disks 56.

With the opening sleeve 32 in its open position, an increased rate of fluid flow will be permitted from the flow passage 18 to the annulus 12. This is due to the fluid flow being able to pass from the flow passage 18 to the annulus 12 via the closing sleeve ports 58 and the housing ports 38, without having to pass through the relatively restrictive rupture disks 56. The operator at the surface will observe the increased flow rate as a positive indication that the opening sleeve 32 has shifted to its open position.

Cement 70 can now be flowed from the flow passage 18 to the annulus 12 via the closing sleeve ports 58 and the housing ports 38. Note that, due to the plug 22 blocking flow through the flow passage 18 at the opening sleeve 32, the cement 70 does not flow into the flow passage 18 downhole of the plug and the opening sleeve. This advantageously reduces the amount of cement 70 that will later need to be drilled or milled out of the flow passage 18.

As a contingency measure, if it previously had not been possible to open the rupture disks 56 in order to circulate the plug 22 to the opening sleeve 32, it would still be possible to shift the opening sleeve to its open position by applying a predetermined pressure differential from the flow passage 18 to the annulus 12. This is due to a differential piston area on the opening sleeve 32 resulting from the difference in diameter between the upper and lower seals 46, 48. This differential piston area enables the predetermined pressure differential from the flow passage 18 to the annulus 12 to apply a downwardly directed biasing force to the opening sleeve 32, and thereby shear the shear members 40 and displace the opening sleeve downward to the open position.

Figure 5:
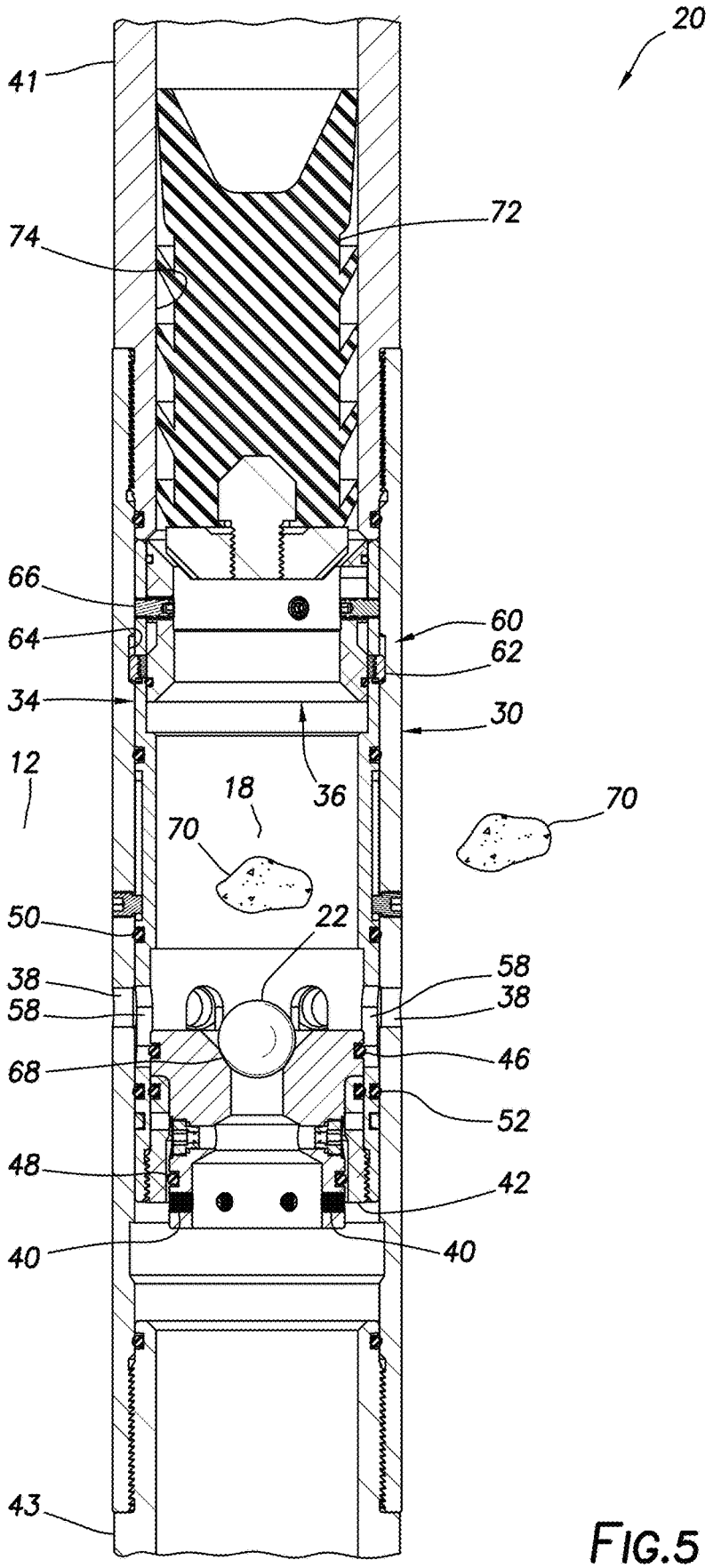
FIG. 5 is a representative cross-sectional view of the cementing stage tool in an end-of-stage configuration.

Referring additionally now to FIG. 5, a cross-sectional view of the cementing stage tool 20 is representatively illustrated. As depicted in FIG. 5, the cementing stage tool 20 is in an end-of-stage configuration.

In the FIG. 5 example, the cement 70 has been placed in the annulus 12. There is also a relatively small amount of the cement 70 in the flow passage 18 uphole of the plug 22 and seat 68. However, there is no cement in the flow passage 18 downhole of the plug 22 and seat 68.

A closing plug 72 has been displaced through the flow passage 18 following the cement 70. The plug 72 is sealingly engaged in a bore 74 of the upper connector 41. As depicted in FIG. 5, the plug 72 is in the form of a dart, but other types of plugs may be used in other examples. In other examples, the plug 72 could be sealingly engaged with another component of the cementing stage tool 20 (such as, the closing sleeve 34 or the release sleeve 36).

Figure 6:
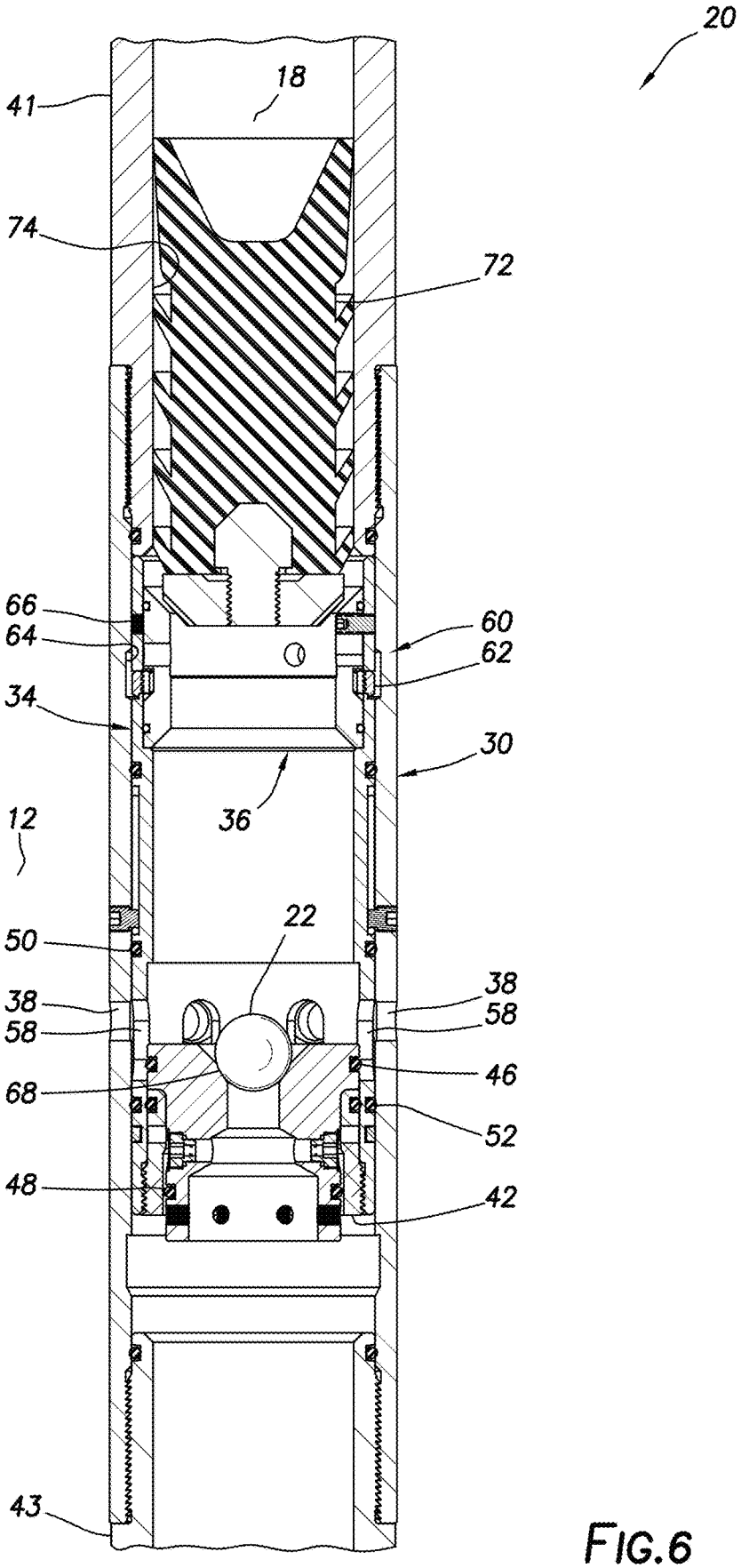
FIG. 6 is a representative cross-sectional view of the cementing stage tool in a closing sleeve unlocked configuration.

Referring additionally now to FIG. 6, a cross-sectional view of the cementing stage tool 20 is representatively illustrated. As depicted in FIG. 6, the cementing stage tool 20 is in a closing sleeve 34 unlocked configuration.

In the unlocked configuration, a predetermined pressure differential has been applied across the plug 72 (from a portion of the flow passage 18 uphole of the plug 72 to a portion of the flow passage downhole of the plug) to thereby apply a downwardly directed biasing force to the release sleeve 36. This biasing force shears the shear members 66 and displaces the release sleeve 36 downward.

In its downwardly displaced unlocked position, the release sleeve 36 no longer outwardly supports the lock rings 62 in engagement with the annular recess 64. As a result, the lock rings 62 can retract radially inward. With the lock rings 62 retracted radially inward, the closing sleeve 34 is no longer prevented from displacing axially relative to the outer housing assembly 30.

Figure 7:
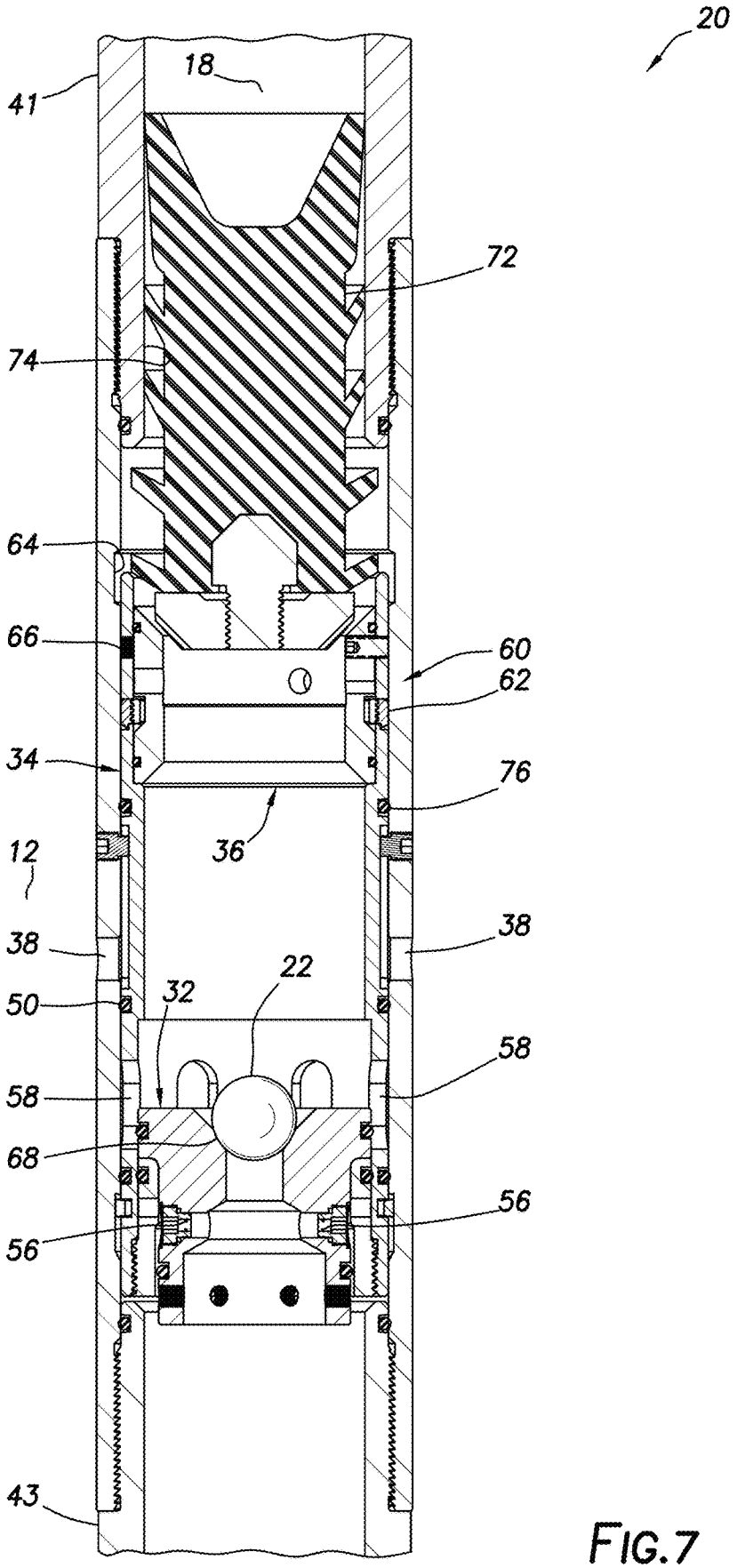
FIG. 7 is a representative cross-sectional view of the cementing stage tool in a closed configuration.

Referring additionally now to FIG. 7, a cross-sectional view of the cementing stage tool 20 is representatively illustrated. As depicted in FIG. 7, the cementing stage tool 20 is in a closed configuration.

Once the release sleeve 36 is displaced to its unlocked position as described above, the downwardly directed biasing force due to the pressure differential across the plug 72 will cause the closing sleeve 34 to displace downward to its closed position as depicted in FIG. 7. In this closed position, seals 50, 76 straddling the housing ports 38 prevent fluid communication between the flow passage 18 and the annulus 12 via the housing ports. The seals 50, 76 seal between the closing sleeve 34 and the outer housing assembly 30 on opposite sides of the housing ports 38.

If it is desired to later establish fluid communication longitudinally through the cementing stage tool 20, the flow passage 18 can be drilled or milled out. Preferably, all of the internal components of the cementing stage tool 20 (including but not limited to the plug 72, the plug 22, the opening sleeve 32 and the rupture disks 56) are made of materials that can be readily drilled or milled through.

It may now be fully appreciated that the above disclosure provides to the art an improved cementing stage tool 20 and associated methods. In examples described above, the cementing stage tool 20 enables circulating fluid flow 24 to be established at the tool, even though a bridge plug 26 has been set in the flow passage 18 downhole of the tool, or a packer 28 has been set in the annulus 12 downhole of the tool. In this way, the plug 22 can be displaced to the cementing stage tool 20 prior to flowing cement 70 to the tool, thereby preventing the cement from flowing into the flow passage 18 downhole of the tool.

The above disclosure provides to the art a method of cementing a tubular string 14 in a wellbore 16. In one example, the method can comprise: applying a first predetermined pressure differential from a flow passage 18 extending axially through the tubular string 14 to an annulus 12 surrounding the tubular string 14, thereby opening a rupture disk 56 of a cementing stage tool 20 connected in the tubular string 14; and then flowing a fluid through the flow passage 18 and into the annulus 12 via the rupture disk 56, thereby displacing an opening plug 22 into engagement with an opening sleeve 32 of the cementing stage tool 20.

The method may include, after the flowing step, applying a second predetermined pressure differential from the flow passage 18 to the annulus 12, thereby displacing the opening sleeve 32 to an open position. A rate of fluid flow from the flow passage 18 to the annulus 12 after the rupture disk 56 opening and prior to the step of displacing the opening sleeve 32 to the open position may be less than a rate of fluid flow from the flow passage 18 to the annulus 12 after the step of displacing the opening sleeve 32 to the open position.

The method may include, after the step of displacing the opening sleeve 32 to the open position, flowing cement 70 from an uphole portion of the flow passage 18 to the annulus 12. The opening plug 22 prevents the cement 70 from flowing into a downhole portion of the flow passage 18, the downhole portion of the flow passage 18 being disposed opposite the opening plug 22 from the uphole portion of the flow passage 18.

During the first pressure differential applying step, the flow passage 18 may be isolated from the annulus 12 downhole of the cementing stage tool 20.

The step of opening the rupture disk 56 may include permitting fluid communication through at least one circulation port 54 formed through a sidewall of the opening sleeve 32. The step of opening the rupture disk 56 may also include permitting fluid communication between the flow passage 18 and the annulus 12 via the circulation port 54, a housing port 38 formed through a sidewall of an outer housing assembly 30, and a closing sleeve port 58 formed through a sidewall of a closing sleeve 34 positioned between the opening sleeve 32 and the outer housing assembly 30.

The above disclosure also provides to the art a cementing stage tool 20 for use with a subterranean well. In one example, the cementing stage tool 20 can comprise: a flow passage 18 extending longitudinally through the cementing stage tool 20; an outer housing assembly 30 including a housing port 38 extending through a sidewall of the outer housing assembly 30; an opening sleeve 32 releasably secured against axial displacement in the outer housing assembly 30, the opening sleeve 32 being configured to prevent fluid flow between the flow passage 18 and the housing port 38 in a run-in configuration of the cementing stage tool 20; and a rupture disk 56 configured to prevent fluid flow between the flow passage 18 and the housing port 38. The rupture disk 56 is configured to permit fluid flow between the flow passage 18 and the housing port 38 in response to a predetermined pressure differential applied from the flow passage 18 to the housing port 38.

The rupture disk 56 may be disposed in a sidewall of the opening sleeve 32. The rupture disk 56 may prevent fluid flow through a circulation port 54 formed through a sidewall of the opening sleeve 32, the circulation port 54 being positioned between first and second seals 46, 48 that isolate an annulus 44 between the opening sleeve 32 and a closing sleeve 34 in the outer housing assembly 30.

The first seal 46 may have a diameter which is greater than a diameter of the second seal 48. In some examples, the first seal 46 may have a diameter which is less than or equal to a diameter of the second seal 48. The closing sleeve 34 may have a closing sleeve port 58 that permits fluid communication between the annulus 44 and the housing port 38.

The opening sleeve 32 may include a seat 68 configured for engagement with an opening plug 22. The opening sleeve 32 may be configured to displace to an open position in which fluid flow between the flow passage 18 and the housing port 38 is permitted in response to a predetermined pressure differential applied across the opening plug 22. The opening plug 22 is sealed with the opening sleeve 32 in an example described above.

The rupture disk 56 may be configured to permit the fluid flow 24 between the flow passage 18 and the housing port 38 at a reduced flow rate as compared to the fluid flow 24 between the flow passage 18 and the housing port 38 permitted with the opening sleeve 32 in the open position.

Another method described above for cementing a tubular string 14 in a wellbore 16 can comprise: applying a first predetermined pressure differential from a flow passage 18 extending axially through the tubular string 14 to an annulus 12 surrounding the tubular string 14, thereby permitting fluid communication between the flow passage 18 and the annulus 12 via a circulation port 54 formed through a sidewall of an opening sleeve 32 of a cementing stage tool 20; and then applying a second predetermined pressure differential from the flow passage 18 to the annulus 12, thereby displacing the opening sleeve 32 to an open position and permitting fluid communication between the flow passage 18 and the annulus 12 without flowing through the circulation port 54.

The method may include, after the step of applying the first predetermined pressure, then flowing a fluid through the flow passage 18 and into the annulus 12 via the circulation port 54, thereby displacing an opening plug 22 into engagement with the opening sleeve 32.

The step of permitting fluid communication between the flow passage 18 and the annulus 12 via the circulation port 54 may comprise opening a rupture disk 56.

A rate of fluid flow 24 from the flow passage 18 to the annulus 12 after step of the permitting fluid communication between the flow passage 18 and the annulus 12 via the circulation port 54 and prior to the step of displacing the opening sleeve 32 to the open position may be less than a rate of fluid flow from the flow passage 18 to the annulus 12 after the step of displacing the opening sleeve 32 to the open position.

During the first pressure differential applying step, the flow passage 18 may be isolated from the annulus 12 downhole of the cementing stage tool 20.

The step of permitting fluid communication between the flow passage 18 and the annulus 12 via the circulation port 54 may include permitting fluid communication through a housing port 38 formed through an outer housing assembly 30, and a closing sleeve port 58 formed through a sidewall of a closing sleeve 34 positioned between the opening sleeve 32 and the outer housing assembly 30.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A cementing stage tool for use with a subterranean well, the cementing stage tool comprising:

a flow passage extending longitudinally through the cementing stage tool;

an outer housing assembly including a housing port extending through a sidewall of the outer housing assembly;

an opening sleeve releasably secured against axial displacement in the outer housing assembly, the opening sleeve configured to prevent fluid flow between the flow passage and the housing port in a run-in configuration of the cementing stage tool;

a rupture disk configured to prevent fluid flow between the flow passage and the housing port, in which the rupture disk is disposed in a sidewall of the opening sleeve, and in which the rupture disk is configured to permit fluid flow between the flow passage and the housing port in response to a predetermined pressure differential applied from the flow passage to the housing port; and a closing sleeve configured to prevent fluid flow between the flow passage and the housing port in a closed configuration of the cementing stage tool.

2. The cementing tool of claim 1, in which the rupture disk prevents fluid flow through a circulation port formed through the sidewall of the opening sleeve, the circulation port being positioned between first and second seals that isolate an annulus between the opening sleeve and the closing sleeve in the outer housing assembly.

3. The cementing tool of claim 2, in which the first seal has a diameter which is greater than a diameter of the second seal.

4. The cementing tool of claim 2, in which the closing sleeve has a closing sleeve port that permits fluid communication between the annulus and the housing port.

5. The cementing tool of claim 1, in which the opening sleeve includes a seat configured for engagement with an opening plug, the opening sleeve being configured to displace to an open position in which fluid flow between the flow passage and the housing port is permitted in response to a predetermined pressure differential applied across the opening plug.

6. The cementing tool of claim 5, in which the rupture disk is configured to permit the fluid flow between the flow passage and the housing port at a reduced flow rate as compared to the fluid flow between the flow passage and the housing port permitted with the opening sleeve in the open position.

* * * * *